US006121734A

United States Patent [19]

Szabados

[11] Patent Number: 6,121,734

[45] Date of Patent: Sep. 19, 2000

[54] APPARATUS FOR DIMMING A FLUORESCENT LAMP WITH A MAGNETIC BALLAST

[76] Inventor: Barna Szabados, 576 Tomahawk Cresent, Ancaster, Ontario, Canada, L9G 3T5

[21] Appl. No.: 09/173,067

[22] Filed: Oct. 16, 1998

[51] Int. Cl.[7] ..... G05F 1/00

[52] U.S. Cl. ..... 315/291; 315/307; 315/209 R; 315/224; 315/DIG. 4

[58] Field of Search ..... 315/291, 307, 315/308, 209 R, 224, 247, DIG. 4, DIG. 7

[56] References Cited

U.S. PATENT DOCUMENTS

| | | | |
|---|---|---|---|
| 3,906,302 | 9/1975 | Wijsboom | 315/209 |
| 4,302,717 | 11/1981 | Olla | 323/282 |
| 4,350,935 | 9/1982 | Spira et al. | 315/291 |
| 4,535,399 | 8/1985 | Szepesi | 363/41 |
| 4,640,389 | 2/1987 | Kamaike | 187/119 |
| 4,970,437 | 11/1990 | Stevens | 315/209 |
| 5,371,440 | 12/1994 | Liu et al. | 315/209 |
| 5,381,077 | 1/1995 | McGuire | 315/247 |
| 5,416,387 | 5/1995 | Cuk et al. | 315/209 R |
| 5,449,981 | 9/1995 | Auld, Jr. et al. | 315/308 |
| 5,500,575 | 3/1996 | Ionescu | 315/307 |
| 5,719,474 | 2/1998 | Vitello | 315/307 |
| 5,757,145 | 5/1998 | Johnson et al. | 315/308 |

FOREIGN PATENT DOCUMENTS

| | | |
|---|---|---|
| 0 576 271A | 12/1993 | European Pat. Off. . |
| 42 00 900 | 9/1972 | Germany . |
| 2 067 318A | 7/1981 | United Kingdom . |
| WO 99/20084 | 4/1999 | WIPO . |

*Primary Examiner*—Haissa Philogene
*Attorney, Agent, or Firm*—Ridout & Maybee

[57] ABSTRACT

A current controlled dimmer for controlling the output intensity of a fluorescent lamp with a magnetic ballast. The current controlled dimmer generates an AC current which follows the shape of the AC line voltage for the fluorescent lamp. The light intensity output of the fluorescent lamp is controlled by varying the amplitude of the AC current. The AC current is generated using a pulse width modulator (PWM) to modulate the AC line voltage. The current controlled dimmer 10 utilizes a feedback control loop which applies proportional and integral (PI) control to the PWM modulation. In another embodiment of the current controlled dimmer, the AC current is generated by rectifying the AC line voltage and modulating the rectified voltage by a pulse width modulator (PWM) into positive and negative cycles to generate a 60 Hz AC current signal.

12 Claims, 12 Drawing Sheets

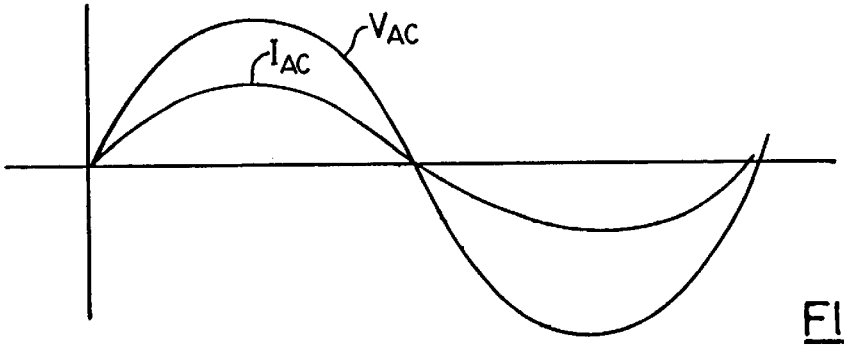
FIG. 2a
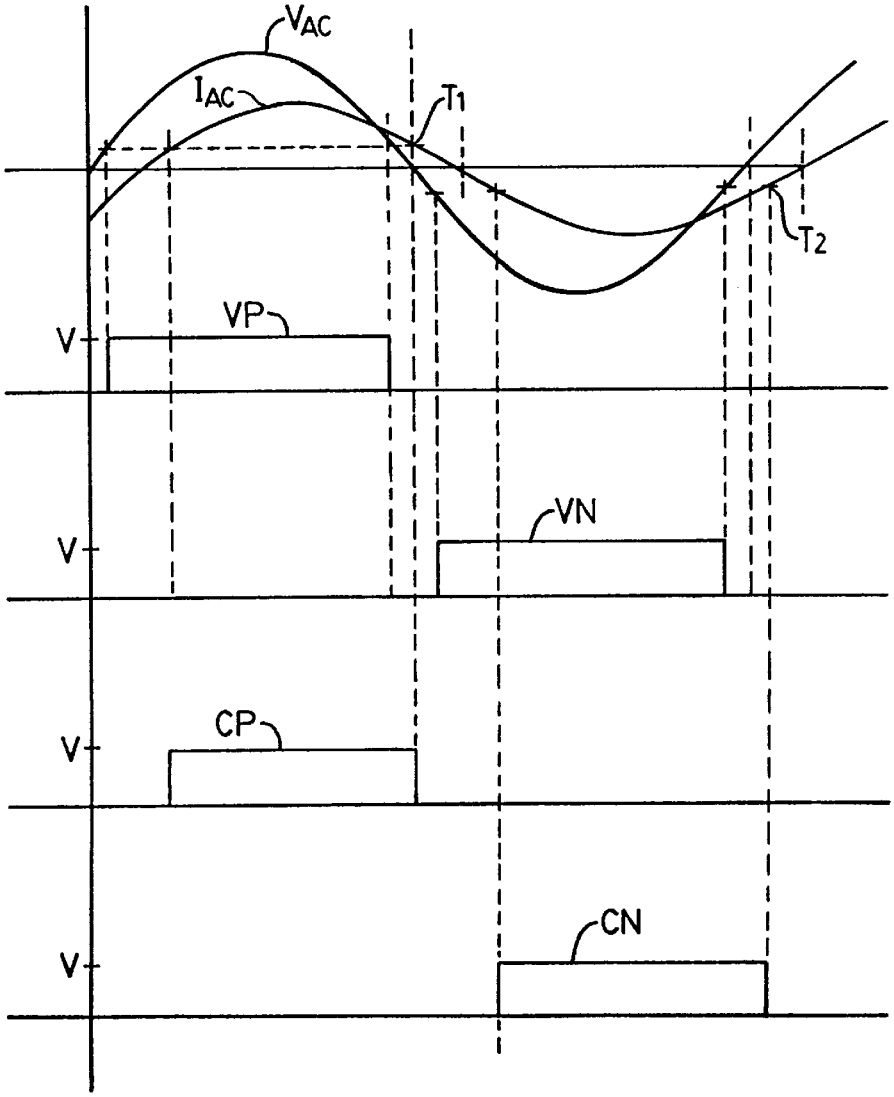
FIG. 2b
FIG. 2c
FIG. 2d
FIG. 2e
FIG. 2f

OPEN LOOP CONTROL

APPARATUS FOR DIMMING A FLUORESCENT LAMP WITH A MAGNETIC BALLAST

FIELD OF THE INVENTION

The present invention relates to a dimmer for fluorescent lighting systems, and more particularly to a dimmer which controls the AC current from the power line to vary the output intensity of a fluorescent lamp having a magnetic ballast.

BACKGROUND OF THE INVENTION

One way of controlling escalating energy costs is by limiting energy consumption. In a modern office building, the principle energy consumers are lighting and heating and cooling. To conserve energy, the thermostat is "turned back" and the lighting is reduced during non-office hours. Reducing the energy consumption from lighting essentially involves dimming the lamps or turning off selected lamps. To conserve energy during non-office hours, most banks of lamps on a floor are turned off, with a few banks of lamps being left on to provide some lighting for security. The other approach to conserving energy consumption involves dimming the fluorescent lamps during non-office hours. As a result of being dimmed less power is consumed, while at the same time a minimum light level is maintained for security purposes.

In a typical office building the lighting system comprises banks or groups of fluorescent lamps. A fluorescent lamp is a type of lamp in which light is generated by fluorescence. The most common form of fluorescent lamp comprises a gas-discharge tube which contains a low-pressure gas such as mercury. The inner surface of the tube is coated with phosphor and when a current passes through the tube a discharge results and the ultraviolet radiation produced strikes the phosphor which then emits visible radiation. To start the discharge, i.e. turn on the lamp, the current must be provided at a sufficiently high voltage level, and typically a form of ballast circuit is utilized to produce the discharge current.

Compared to incandescent lamps, fluorescent lamps present special problems with respect to dimming. Various solutions have been proposed for dimming fluorescent lamps, including a magnetic ballast, an electronic ballast, and an electronically tapped voltage transformer.

The magnetic ballast solution produces a high voltage when there is no discharge in the lamp (i.e. the lamp is not conducting) and also feeds a "cathode heater circuit". When the arc (i.e. discharge) starts in the tube, the voltage at the output of the secondary winding on the ballast collapses to a level which is necessary to sustain the arc. The ballast absorbs, i.e. through its inductance, the excess voltage from the power source. There have been several dimmers proposed in the art based on the variation of the voltage controlling the discharge in the lamp, but none of these solutions have achieved any commercial success.

Another type of known dimmer for fluorescent lamps is based on an electronic ballast. The electronic ballast generates a rectified DC voltage from a power source and injects a resonant current into the lamp tube. The resonant current has a relatively high frequency (typically 20 kHz) and as a result special tubes are required for the fluorescent lamps. Each lamp requires an electronic ballast. The electronic ballast is modified for dimming control by providing a variable DC voltage.

In view of the shortcomings with the state of art devices, there remains a need for a dimmer for use with fluorescent and other types of gas discharge lamps.

BRIEF SUMMARY OF THE INVENTION

The present invention provides a current controlled dimmer for fluorescent lamps. The current controlled dimmer generates a feedback controlled current signal output with a waveshape which follows the voltage drive signal for the lamp. By varying the amplitude of the current output signal, the output intensity of the fluorescent lamp can be decreased (i.e. dimmed) or increased (i.e. intensified). According to the invention, the voltage drive signal across the lamp electrodes (i.e. ballast) is kept constant and a constant heating current is maintained so that the lamp can respond almost instantaneously to an increase in the amplitude of the current signal.

In accordance with the present invention, the current signal output is obtained by modulating the AC line (i.e. drive) voltage to generate an AC current signal. The current controlled dimmer utilizes a feedback control loop which applies proportional/integral (PI) control to the PWM control signal to superimpose a fast response (e.g. 2 kHz) over the steady state base chopping rate. Advantageously, this feature eliminates noticeable flicker in the lamp output. The generated AC current signal output has quasi-sinusoidal waveform which follows the sinusoidal voltage waveform over the range of operation.

In one aspect, the present invention provides an apparatus for controlling the output intensity level of a gas discharge lamp having a magnetic ballast, the apparatus comprising: (a) means for coupling an AC supply voltage to the magnetic ballast for energizing the ballast to produce a discharge in the gas discharge lamp; (b) means for generating an intensity level signal for setting the output intensity level for the lamp; (c) switch means for switching the AC supply voltage to generate an AC current for powering the gas discharge lamp, the switch means being responsive to a chopping control signal for varying the amplitude of the AC current and thereby varying the output intensity of the lamp; (d) controller means for controlling the switch means, the controller means including a pulse width modulator for generating the chopping control signal, the pulse width modulator having means responsive to the intensity level signal for generating the chopping control signal with a duty cycle derived from the intensity level signal.

In another aspect, the present invention provides an apparatus for controlling the output intensity level of a gas discharge lamp having a magnetic ballast or a group of lamps each having a magnetic ballast and being connected to a single protection device such as a circuit breaker or fuse, the apparatus comprising: (a) means for coupling an AC voltage to the magnetic ballast for energizing the ballast to produce a discharge in the gas discharge lamp; (b) means for generating an intensity level signal for setting the output intensity level for the lamp; (c) switch means for switching the AC voltage to generate an AC current for powering the gas discharge lamp, the switch means being responsive to a chopping control signal; (d) controller means for controlling the switch means, the controller means having means responsive to the intensity level signal and including a pulse width modulator for generating the chopping control signal and the chopping control signal having a duty cycle derived from the intensity level signal.

In yet another aspect, the present invention provides a method for controlling the output intensity level of a gas discharge lamp having a magnetic ballast, the method comprising the steps of: (a) applying a voltage to the magnetic ballast for energizing the ballast and producing a discharge in the gas discharge lamp; (b) modulating the voltage to produce an alternating current for powering the gas discharge lamp, the alternating current having a controllable waveshape substantially following a reference signal; (c) generating an intensity level signal from the reference signal for setting the output intensity of the lamp; (d) varying the modulation of the voltage in response to an error signal, the error signal comprising the difference between the intensity level signal and a feedback current signal, so that the output intensity level of the gas discharge lamp follows the reference signal.

In another aspect, the present invention provides a method for controlling the output intensity level of a gas discharge lamp having a magnetic ballast, the method comprising the steps of: (a) applying a voltage to the magnetic ballast for energizing the ballast and producing a discharge in the gas discharge lamp; (b) modulating the voltage signal to produce an alternating current with a variable magnitude for powering the gas discharge lamp; (c) inputting an intensity level signal for setting the output intensity level of the lamp; (d) varying the modulation of the voltage in response to the intensity level signal to change the magnitude of the alternating current and thereby vary the output intensity of the gas discharge lamp.

Advantageously, the current controlled dimmer according to the present invention provides the following beneficial features. Current control of the lamp output suppresses flicker which results in a steady light emission from the lamp. The constant light emission, in turn, produces a perceived brighter output even though the lamp is powered at a lower level. Operation at less than full power (e.g. 80%) improves the operating life of the ballast in the lamp by reducing excess heating. Furthermore, the balancing of the current signal also reduces overheating in the ballast and eliminates harmonics. It has been found that the injection of even order harmonics can be particularly detrimental to the longevity of the ballast in a fluorescent lamp. In addition, the slight lag in the current feedback produces a phase advance in the current signal which allows the power factor to be maintained above 0.9.

BRIEF DESCRIPTION OF THE DRAWINGS

Reference will now be made to the accompanying drawings which show, by way of example, preferred embodiments of the present invention, and in which:

FIGS. 2(*a*) to 2(*f*) are timing diagrams for signals associated with the current controlled dimmer of FIG. 1;

DETAILED DESCRIPTION OF THE PREFERRED EMBODIMENTS

Figure 1:
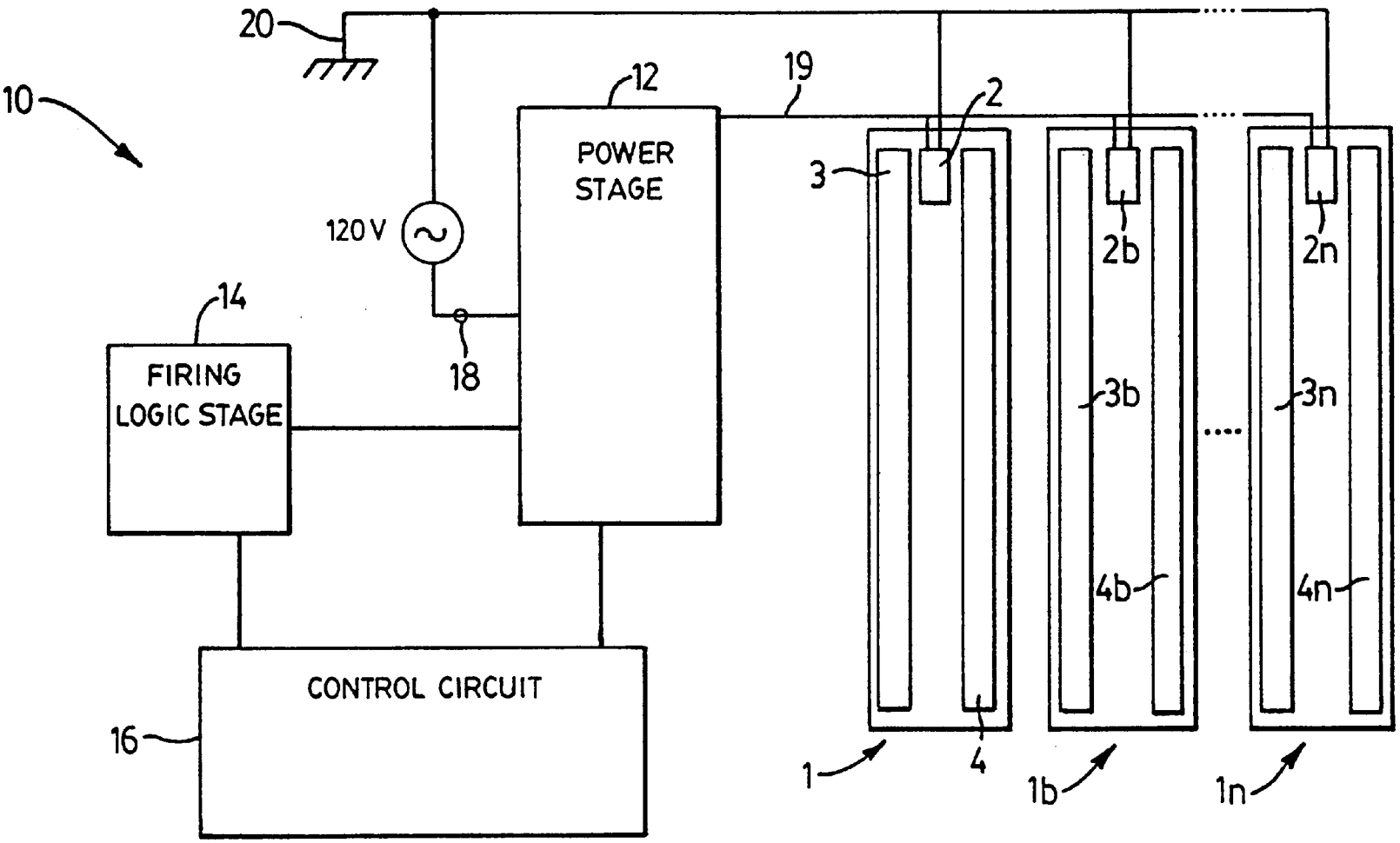
FIG. 1 shows in block diagram a current controlled dimmer for a fluorescent lamp.

As will now be described, the present invention comprises a current controlled dimmer as shown in FIG. 1 and denoted generally by reference 10. The current controlled dimmer 10 according to the invention generates a current signal which follows the shape of the AC drive or line voltage signal for a fluorescent lamp. The light intensity output of the fluorescent lamp is controlled by varying the amplitude of the current signal. The current signal is generated by using a pulse width modulator (PWM) to modulate the AC line voltage. The current controlled dimmer 10 utilizes a feedback control loop which applies proportional/integral (PI) control to the PWM control signal to superimpose a fast response (i.e. 2 kHz) over the steady state base chopping rate.

As will be familiar to those skilled in the art, a fluorescent light or lamp assembly 1 (FIG. 1) typically comprises a magnetic ballast 2 and a pair of glass tubes 3 and 4. The glass tubes 3 and 4 are typically filled with mercury vapour and have a phosphorescent coating on the inside surface. Excitation of an electrode in each of the glass tubes 3,4 with a high voltage causes ionization of the mercury vapour and the emission of ultraviolet light. The ultraviolet light activates the fluorescent coating on the inside surface of the glass tubes 3 and 4. More specifically, the electrons emitted by the electrode collide with electrons in the outer rings of the mercury atoms and ultraviolet radiation is produced. The ultraviolet radiation, in turn, acts on phosphor crystals applied to the inside of the glass wall to produce light. The electrode is connected in series to the magnetic ballast 2. The ballast 2 comprises an iron-core inductive element which provides the required high starting voltage for energizing the electrode while limiting the operating current.

Reference is now made to FIG. 1 which shows in block diagram form a current controlled dimmer 10 for use with a fluorescent light or lamp assembly 1 or a group of lamp assemblies, shown individually as 1*a*, 1*b*, . . . 1*n*. Each lamp assembly 1 includes a pair of fluorescent tubes 3 and 4, and the magnet ballast 2. The lamp assemblies 1 are connected in parallel to the current controlled dimmer 10 and dimmer 10 is provided for each circuit breaker (not shown) which is connected to a group of lamp assemblies 1. For example, for a 15 Ampere circuit breaker (not shown) ten to twelve lamp assemblies 1 (nominally rated at 1 Ampere each) would be connected to single current controlled dimmer 10. As will be described, the current controlled dimmer 10 according to the present invention varies the amplitude of the current to the magnetic ballast 2 in order to control output intensity of the fluorescent tubes 3 and 4 in the lamp assembly 1.

As shown in FIG. 1, the current controlled dimmer 10 comprises a power stage 12, a firing stage 14, and a control circuit 16. The ballast 2 in the lamp assembly 1 is coupled to a live output terminal 19 from the power stage 12, and the return or neutral line 20 for the AC supply or line voltage. The power stage 12 is powered by AC line or supply voltage which is connected to live 18 and neutral 20 terminals. The AC line voltage is typically 110 or 220 Volts RMS.

Figure 3:
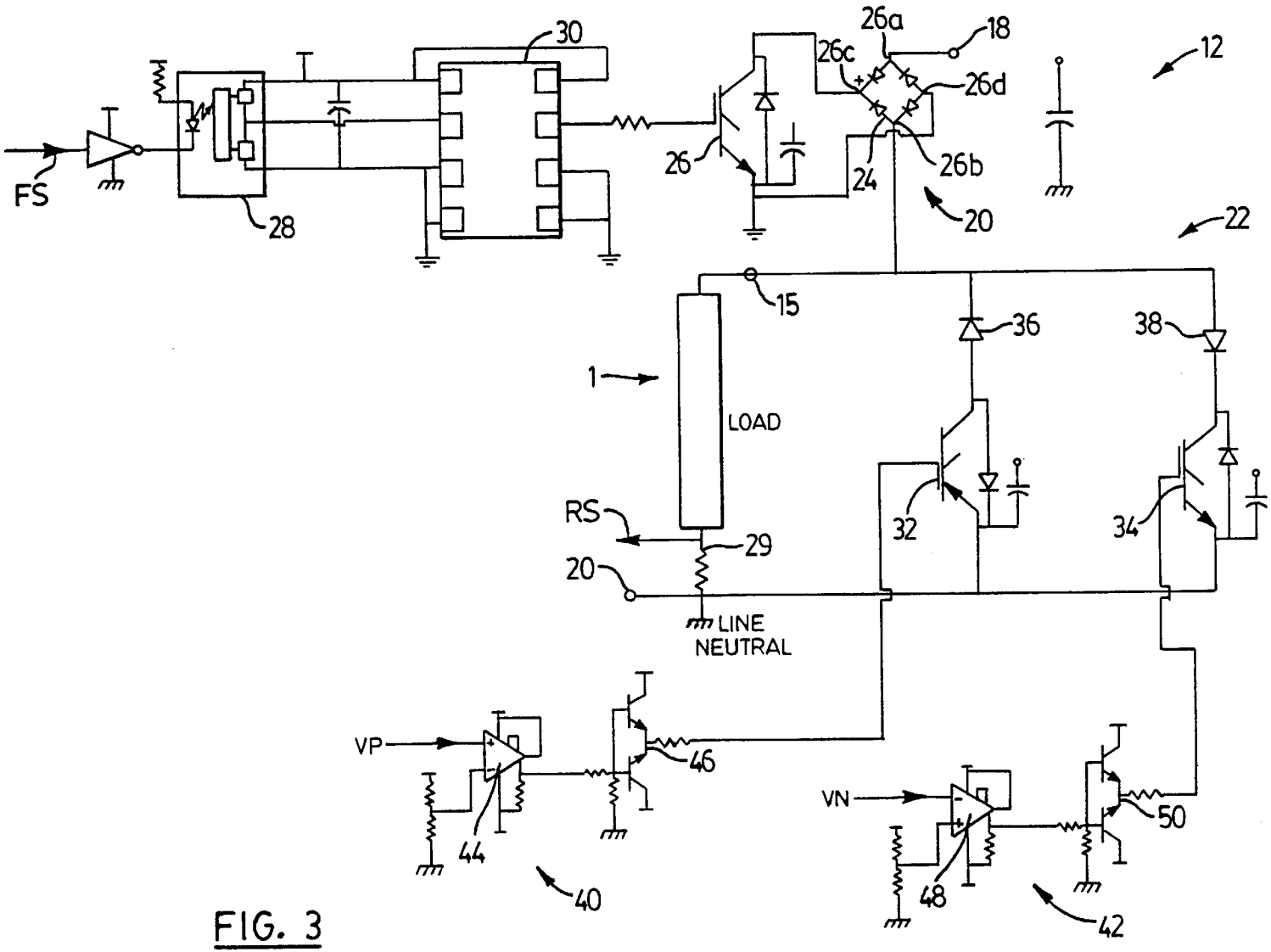
FIG. 3 is a schematic diagram of a power stage for the current controlled dimmer of FIG. 1.
Figure 4:
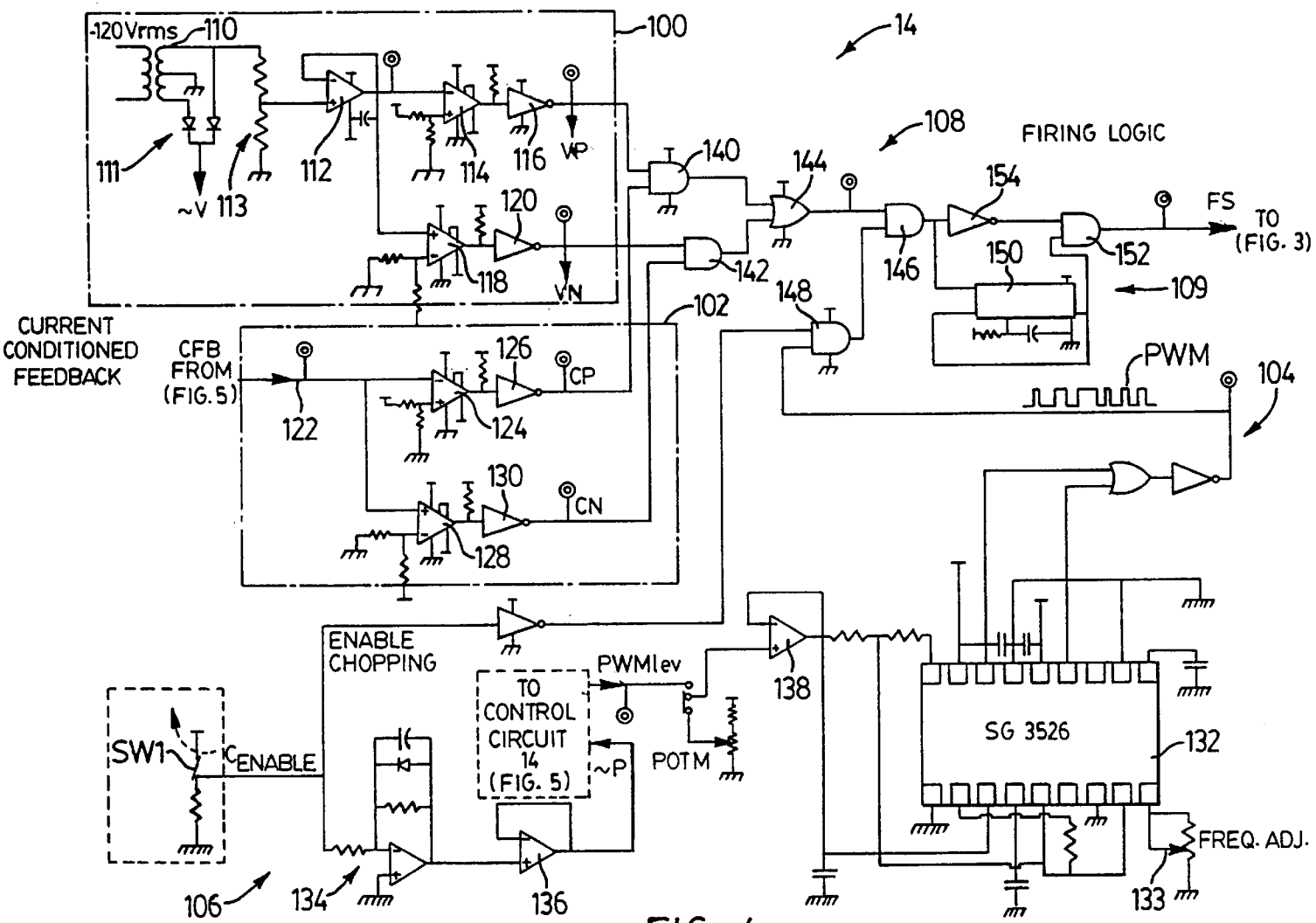
FIG. 4 is a schematic diagram of a firing logic stage for the current controlled dimmer of FIG. 1.

Reference is made to FIG. 3, which shows the power stage 12 in greater detail. The power stage 12 comprises an AC switching stage 20 and an output stage 22. The AC switching stage 20 switches the AC line voltage through the load, i.e. lamp assembly 1, in response to a modulation or chopping control signal FS which is generated by the firing logic stage 14 (FIG. 4). The output stage 22 controls the cycling of the current signal through the magnetic ballast 2 (FIG. 1) as will be described below.

The AC switching stage 20 comprises a full-wave bridge rectifier 24 and an insulated gate bipolar transistor (IGBT) 26. In known manner, the bridge rectifier 24 comprises four diodes D which are connected in a bridge configuration to form two pairs of nodes or junctions 26*a*,26*b* and 26*c*,26*d*. The AC line voltage from terminal 18 is applied to node 26*a*, and the other node 26*b* forms the live output terminal 19 which is connected to the live terminal of the ballast 2 (FIG. 1). The return terminal in the ballast 2 is coupled to the neutral return terminal 20 through a shunt resistor 29. The shunt resistor 29 provides a shunt current output signal RS which is utilized by the control circuit 16 as will be described below. The other pair of nodes 26*c*,26*d* are connected across the collector and emitter of the IGBT 26. The transistor 26 functions as the actuator for the AC switch 20 (i.e. bridge 24). The base of the transistor 26 receives a chopping or modulation control signal FS from the firing logic stage 14. To allow for a floating power supply, the modulation control signal FS is coupled through an opto-isolator 28. The output of the opto-isolator 28 is coupled to the base of the IGBT 26 through a driver 30, such as the IR2121. The driver 30 provides 0 to +15V offset for the modulation control signal FS for turning the IGBT 26 ON and OFF. The emitter of the IGBT 26 is connected to isolated ground. When the modulation or chopping control signal FS is HIGH, the IGBT 26 is ON and thus the AC switch 20 is closed, and a current derived from the AC line voltage will flow through the bridge 24 into the magnetic ballast 2 in the lamp assembly 1. Conversely, when the modulation control signal FS is LOW, the IGBT 26 is turned OFF and the AC switch 20 is opened. However, while the AC switch 20 is opened, a free-wheeling path across the load (i.e. the magnetic ballast 2 in the lamp 1) has to be established, and the AC current through the load is modulated with the AC switch 20.

As shown in FIG. 3, the output stage 22 comprises a PNP insulated gate bipolar transistor 32 and a NPN insulated gate bipolar transistor 34. The PNP IGBT 32 together with a diode 36 are coupled across the load (i.e. magnetic ballast 2) as shown. Similarly, the NPN IGBT 34 and diode 38 are also coupled across the magnetic ballast 2. The emitters of both the IGBT's 32, 34 are coupled to the neutral line 20 which serves as the common ground for the dimmer 10. The IGBT's 32, 34 and associated diodes 36, 38 provide free-wheeling paths when the AC switch 20 is open. Since the magnetic ballast 2 comprises an inductive load, a path must be provided to remove the energy stored in the ballast 2 when the switch 20 is open. The IGBT 34 and diode 38 provide a free-wheeling path for the negative cycle of the AC, and the IGBT 32 and diode 36 provide a path for the positive cycle. Each of the IGBT's 32, 34 are actuated by respective drive circuits 40, 42. The drive circuit 40 receives a voltage logic control signal VP generated by the firing logic stage 14, and the drive circuit 42 receives a voltage logic control signal VN, also from the firing logic stage 14. The drive circuit 40 comprises a level shifter 44 for producing a ±15V output. The level shifter 44 includes a push-pull output circuit 46 which is coupled to the base of the IGBT 32. Similarly, the other drive circuit 42 comprises a level shifter 48 for producing a ±15V output and includes a push-pull circuit 50 coupled to the base of the IGBT 34. To turn ON the IGBT 32, −15V is applied to the base, whereas +15V is applied to the base to turn ON the other IGBT 34.

Reference is next made to FIG. 4 which shows the firing logic stage 14 in more detail. As described above, the firing logic stage 14 generates the modulation or chopping control signal FS. The modulation control signal FS controls the actuation of the AC switching stage 20 which in turn controls the amplitude of the AC current signal applied to the magnetic ballast 2 in the lamp assembly 1 or assemblies 1*a* to 1*n*. In addition to the modulation signal FS, the firing logic stage 14 generates the voltage logic control signals VP and VN.

As shown in FIG. 4, the firing logic stage 14 comprises a voltage pulse generator circuit 100, a current pulse generator circuit 102, a pulse width modulator circuit 104, a dimmer level circuit 106, and an output logic circuit 108.

The voltage pulse generator circuit 100 generates the voltage logic control signals VP and VN described above for the power stage 12. The logic control signals VP and VN are derived from the AC line voltage signal as shown in FIGS. 2(*c*) and 2(*d*). The logic control signal VP corresponds to the positive cycle of the AC line voltage $V_{AC}$, and the logic control signal VN corresponds to the negative cycle of the AC line voltage $V_{AC}$. As shown in FIG. 4, the voltage pulse generator circuit 100 comprises a signal transformer 110 having a primary coupled to the AC line voltage $V_{AC}$. The output from the secondary of the transformer 110 is coupled to a voltage follower 112 through a voltage divider 113. The voltage follower 112 provides a synchronizing voltage signal. As shown in FIG. 4, the output from the voltage follower 112 feeds a first comparator 114 and invertor 116 which generate the positive voltage logic control signal VP for the voltage waveform $V_{AC}$ (FIG. 2(*a*)). The voltage follower 112 also feeds a second comparator 118 and invertor 120 which generate the negative voltage logic control signal VN for the voltage waveform $V_{AC}$ (FIG. 2(*a*)). The voltage logic control signals VP and VN from the generator circuit 100 provide inputs to the output logic circuit 108.

Figure 5:
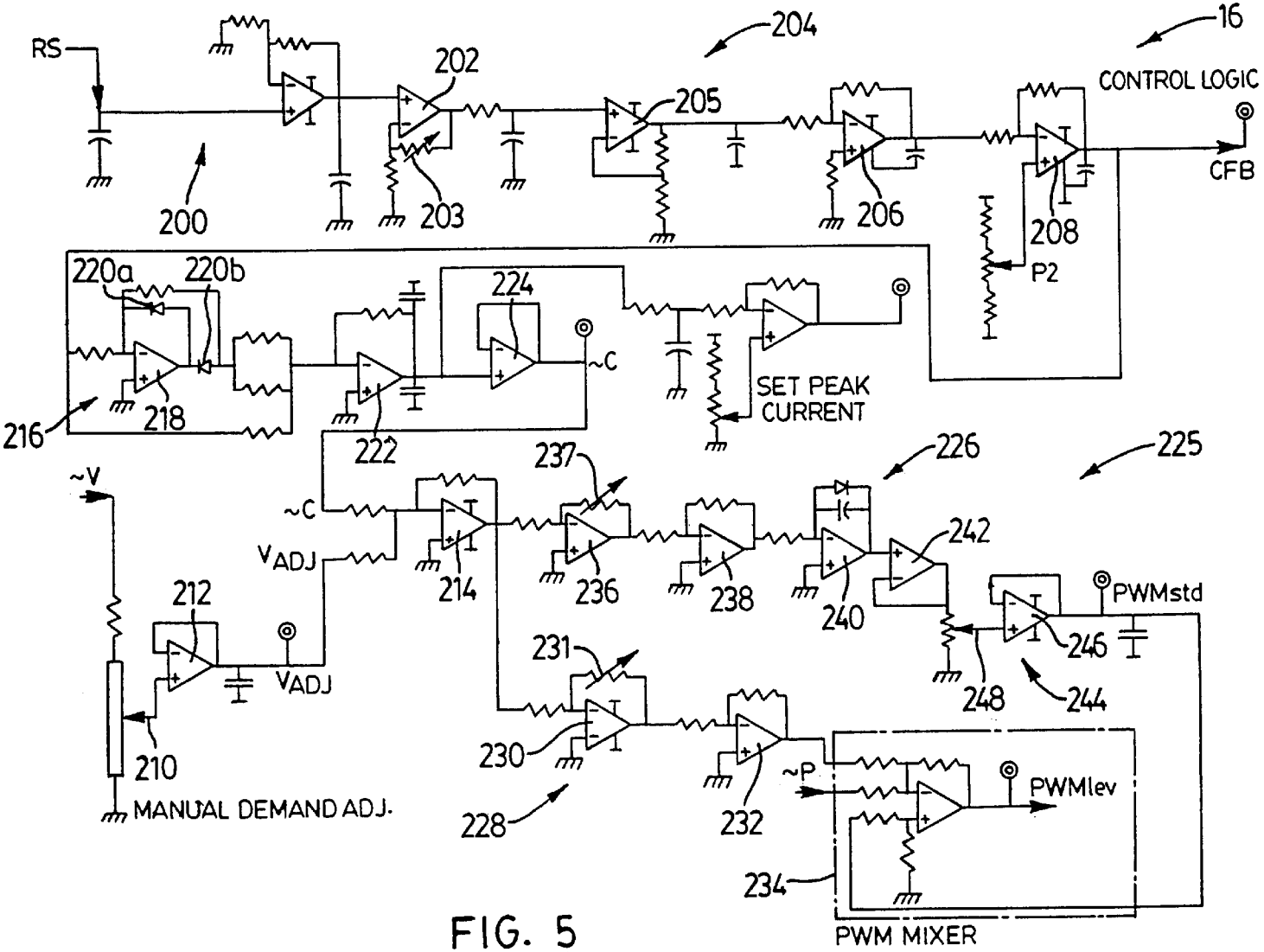
FIG. 5 is a schematic diagram of a control circuit stage for the current controlled dimmer of FIG. 1.

The other inputs to the output logic circuit 108 comprise a positive current logic control signal CP and a negative current logic control signal CN. The current logic control signals CP and CN are used by the output logic circuit 108 to generate the modulation control signal FS (as will be described below). The current logic control signals CP and CN are derived from a conditioned current feedback signal CFB which is received at input 122 from the control circuit 16. Referring to FIG. 5, the conditioned current feedback signal CFB is derived from the shunt current output signal RS from the shunt resistor 29 (FIG. 2). The shunt current signal RS represents the current flowing in the load, i.e. the magnetic ballast 2. As shown in FIG. 5, the conditioned current feedback signal CFB is generated by first converting the shunt current RS into a voltage signal using a current-to-voltage converter 200. The output from the current-to-voltage converter 200 is amplified by a non-inverting amplifier 202 with an adjustable gain set by a potentiometer 203. The output from the amplifier 202 is filtered by a second order Butterworth filter 204 comprising amplifiers 205, 206 configured as shown in FIG. 5. The output from the filter 204 is fed to another inverting amplifier 208 which is configured with a level shifter comprising a potentiometer 209 for correcting offset in the conditioned current feedback signal CFB. In the present embodiment, the peak value of the current signal CFB is set to approximately 5 Volts.

Referring back to FIG. 4, the current pulse generator circuit 102 comprises a first comparator 124 and inverter 126 and a second comparator 128 and inverter 130. The conditioned current feedback signal CFB from the control circuit 16 is coupled to the input of each comparator 124, 128. The first comparator 124 and inverter 126 are configured to generate the logic control signal CP for the positive half-cycle of the AC current waveform $I_{AC}$ as shown in FIG. 2(*e*). Similarly, the second comparator 128 and inverter 130 are configured to generate the logic control signal CN for the negative half-cycle of the AC current waveform $I_{AC}$ as shown in FIG. 2(*f*). The configuration of the comparators 124, 128 will be within the understanding of those skilled in the art. The logic control signals CP and CN are used by the output logic circuit 108 as will be described below.

Referring again to FIG. 4, the pulse width modulator circuit 104 generates a pulse width modulation signal PWM which is used by the output logic circuit 108 to generate the chopping or modulation control signal FS. The pulse width modulator circuit 104 comprises a pulse width modulation generator 132. Preferably, the generator 132 is implemented using a commercially available PWM generator chip, as will be familiar to one skilled in the art. In known manner, the PWM generator 132 is configured to produce a 20 kHz frequency for the pulse width modulation signal PWM. A potentiometer 133 is included for adjusting the output frequency of the generator 132. The pulse width or duty cycle of the pulse width modulation signal PWM is determined by a pulse width modulation level control signal PWMlev. The control signal PWMlev is generated by the control circuit 16 as will now be described.

Referring to FIG. 5, the control circuit 16 generates the modulation level control signal PWMlev from the conditioned current feedback signal CFB and a demand adjust signal $V_{ADJ}$. The demand adjust signal $V_{ADJ}$ represents the desired output level for the lamp assembly 1. The demand adjust signal $V_{ADJ}$ may be set manually or automatically, for example, under computer control as part of lighting control system for an office building or plant. As shown in FIG. 5, the demand adjust signal $V_{ADJ}$ is set using a manually adjustable potentiometer 210. The potentiometer 210 is connected to the output of a rectifier 111 (FIG. 4) which is coupled across the secondary of the transformer 110 (FIG. 4) to generate a rectified voltage reference signal ~V. The output, i.e. wiper, of the potentiometer 210 is coupled to a voltage follower or unity gain buffer 212 which provides the output for the demand adjust signal $V_{ADJ}$. It will be appreciated that the demand adjust signal $V_{ADJ}$ comprises a rectified sinusoidal signal derived from the AC line voltage $V_{AC}$ through the transformer 110 and rectifier 111 (FIG. 4) the amplitude of which is manually controlled by the potentiometer 210. Alternatively, the voltage reference signal ~V may be derived from sinusoidal signal tapped from the transformer 110 and controlled by a variable gain amplifier (not shown) via a microcontroller interface (not shown). In another variation, a sinusoidal signal locked to the AC line voltage $V_{AC}$ is generated utilizing a variable amplitude output signal from a microcontroller. As shown in FIG. 5, the demand adjust signal $V_{ADJ}$ forms one input to an error circuit 214. The other input to the error circuit 214 is derived from the conditioned current feedback signal CFB as will now be described.

As shown in FIG. 5, the conditioned current feedback signal CFB is fed into a precision rectifier 216 which comprises two operational amplifiers 218, 222 and diodes 220*a*, 220*b* configured in known manner. The output signal from the rectifier 216 is conditioned by a voltage follower or unity gain buffer 224 to produce a load current output signal ~C and also provide isolation. The load current output signal ~C provides the other input to the error circuit 214. The error circuit 214 comprises an operational amplifier 215 which is configured in known manner to produce an output signal comprising the sum of the rectified signal CFB and the demand adjust signal $V_{ADJ}$. The output of the error circuit 214 provides an error signal Err which represents the difference between the desired demand, i.e. signal $V_{ADJ}$, and the actual load current, i.e. signal ~C.

Referring to FIG. 5, the error signal Err from the error circuit 214 is fed to a proportional/integral (P/I) feedback control loop indicated generally by reference 225. The feedback control loop 225 comprises two branches: an integral control branch 226 and a proportional control branch 228. The integral controller 226 provides a long time constant and is intended to control the steady state level of the sinusoidal waveform. The integral controller 226 generates a DC base voltage which represents the steady state PWM modulation rate for the pulse width modulation generator 132. The proportional controller 228, on the other hand, is used to correct errors between the desired demand and the actual load current. The proportional controller 228 provides the dynamic modulation signal which directs the pulse width modulation generator 132 to produce the desired sinusoidal shape for the AC current signal $I_{AC}$. The outputs from the integral controller 226 and the proportional controller 228 are mixed with a ramped signal ~P to generate the pulse width modulation level control signal PMWlev.

As shown in FIG. 5, the proportional controller 228 comprises first 230 and second 232 inverting amplifiers. The first inverting amplifier 230 includes a potentiometer 231 for adjusting the gain on the error signal Err. The second inverting amplifier 232 further conditions the error signal Err and produces an error output signal which is enabled by (i.e. summed with) the ramped signal ~P generated by the start-up chopping enable block 106 (FIG. 4). The sum of the error output signal and the signal ~P are applied to the negative input of a PWM mixer 234 which is implemented with a differencing amplifier. As shown in FIG. 5, the positive input of the differencing amplifier 234 receives the output from the steady state integral controller 226.

Referring back to FIG. 4, the signal ~P is derived from a chopping (i.e. dimmer) enable signal $C_{enable}$ which is generated by a switch SW1. The chopping enable signal $C_{enable}$ is active LOW and chopping is enabled when the switch SW1 is open. When the switch SW1 is closed, the chopping enable signal $C_{enable}$ is pulled HIGH, and the modulation control signal FS is disabled (by the output logic 108 as will be described below) so that the full AC line voltage $V_{AC}$ is applied to the lamp assembly 1. The signal ~P is generated by utilizing an integrator 134 to slowly ramp the chopping enable signal $C_{enable}$. As shown in FIG. 4, the ramped signal ~P from the integrator 134 is coupled to the negative input of the differencing amplifier 234 (FIG. 5) through a unity gain buffer or voltage follower 136.

Referring to FIG. 5, the integral controller 226 provides integral control for steady state conditions by generating a DC base voltage which corresponds to the steady PWM rate for the PWM generator 132. The integral controller 226 comprises a first inverting amplifier 236, a second inverting amplifier 238, and an integrator 240. The error signal Err (i.e. the difference between the demand setting $V_{ADJ}$ and the actual load current signal ~C) is applied to the first amplifier 236 which includes a potentiometer 237 for adjusting the gain. The error signal Err is further conditioned by the second amplifier 238 before being applied to the integral controller 226. The amplifiers 236, 238 and the integrator 240 are configured in known manner using operational amplifiers and discrete components as will be within the understanding of those skilled in the art. The output of the integrator 240 is buffered by a voltage follower 242 and coupled to the positive input of the differencing amplifier 234 through a level shifter 244 which allows the level of the integrated error signal Err to be adjusted. As shown in FIG. 5, the level shifter 244 comprises an operational amplifier 246 configured as a unity gain amplifier with a potentiometer 248 coupled to the non-inverting input of the op-amp 246. The pulse width modulation level control signal PWMlev is generated by the PWM mixer 234 as the difference between the steady state error signal (i.e. the output of the integral controller 226) and the sum of the ramped chopped enable signal ~P and the instantaneous error signal (i.e. the output of the proportional controller 228). The pulse width modulation level control signal PWMlev is fed to the PWM generator 132 through a buffer 138. It will be appreciated that the pulse width modulation level signal PWMlev provides an input signal which controls the duty cycle of the pulse width modulation signal PWM under steady state and error conditions.

Referring to FIG. 4, the output logic circuit 108 generates the chopping control signal FS from the voltage logic control signals VP and VN, the current logic control signals CP and CN, and the pulse width modulation signal PWM from the PWM generator 132. In this aspect, chopping or modulation of the AC voltage signal $V_{AC}$ is only allowed when the voltage and current cycles have the same polarity. This condition is fulfilled by logically AND'ing the respective voltage logic control signals VP, VN and the current logic control signals CP, CN. As shown in FIG. 4, the output logic circuit 108 includes an AND logic gate 140 to logically AND the positive voltage logic control signal VP and the positive current logic control signal CP, and another AND gate 142 to logically AND the negative voltage VN and current CN logic control signals. The outputs of the two AND gates 140, 142 are logically OR'd by OR gate 144 so that either condition, i.e. positive polarity or negative polarity, enables generation of the chopping control signal FS. The output of the OR gate 144 is logically AND'd by gate 146 with the output of another AND gate 148. The output of gate 148 comprises the pulse width modulation signal PWM which is enabled by the chopping enable signal $C_{enable}$. Accordingly, the chopping control signal FS is only active when the voltage and current signals have the same polarity and the chopping enable is active.

Referring still to FIG. 4, the output logic circuit 108 includes a delay circuit denoted generally by 109. The delay circuit 109 serves to force a minimum delay for the turn-off time of IGBT 26. As shown in FIG. 4, the delay circuit 109 comprises a delay generator 150 and an AND gate 152. The delay generator 150 is triggered by the rising edge of the output from the AND gate 146. The output from the AND gate 146 is inverted by inverter 154 and provides one input to the AND gate 152. The other input is the delayed output signal from the delay generator 150. Accordingly, the chopping control signal FS is delayed by the generator 150 for a predetermined period. The delay period is based on the turn-off time for the IGBT 26 and for the present embodiment is set at 5 $\mu$sec.

In operation, the dimming function is enabled by opening the switch SW1 (FIG. 4) and manually setting the demand or dimming level for the light assembly 1 using the potentiometer 210 (FIG. 5). In response to the opening of the switch SW1, chopping is enabled by the chopping enable signal $C_{enable}$, and the demand level setting $V_{ADJ}$ is converted into a pulse width modulation level PWMlev (FIG. 5) for the pulse width generator 132 (FIG. 4). The pulse width generator 132, in turn, generates an output signal PWM with the appropriate duty cycle. The pulse width modulation signal PWM is mixed with the output of OR gate 144 (derived from the voltage logic control signals VP, VN and the current logic control signals CP, CN) so that chopping only occurs when the cycles in the AC voltage $V_{AC}$ and AC current $I_{AC}$ signals (FIG. 2(*a*)) have the same polarity. In this way, the resulting AC current signal $I_{AC}$ (FIG. 2(*b*)) is quasi-sinusoidal and essentially tracks the AC voltage $V_{AC}$. If there is a change in the demand or an error between the demand level and the actual load current, the control circuit 16 adjusts the pulse width modulation level PWMlev (FIG. 5) which in turn adjusts the chopping control signal FS. Advantageously, the current controlled dimmer 10 substantially reduces noticeable flicker in the lamp output, and the quasi-sinusoidal shape of the current reduces harmonics which are potentially harmful to the magnetic ballast 2. In addition, the delay introduced by the proportional/integral feedback control loop 225 (FIG. 5) results in a high power factor, typically 0.9 or better.

Figure 6:
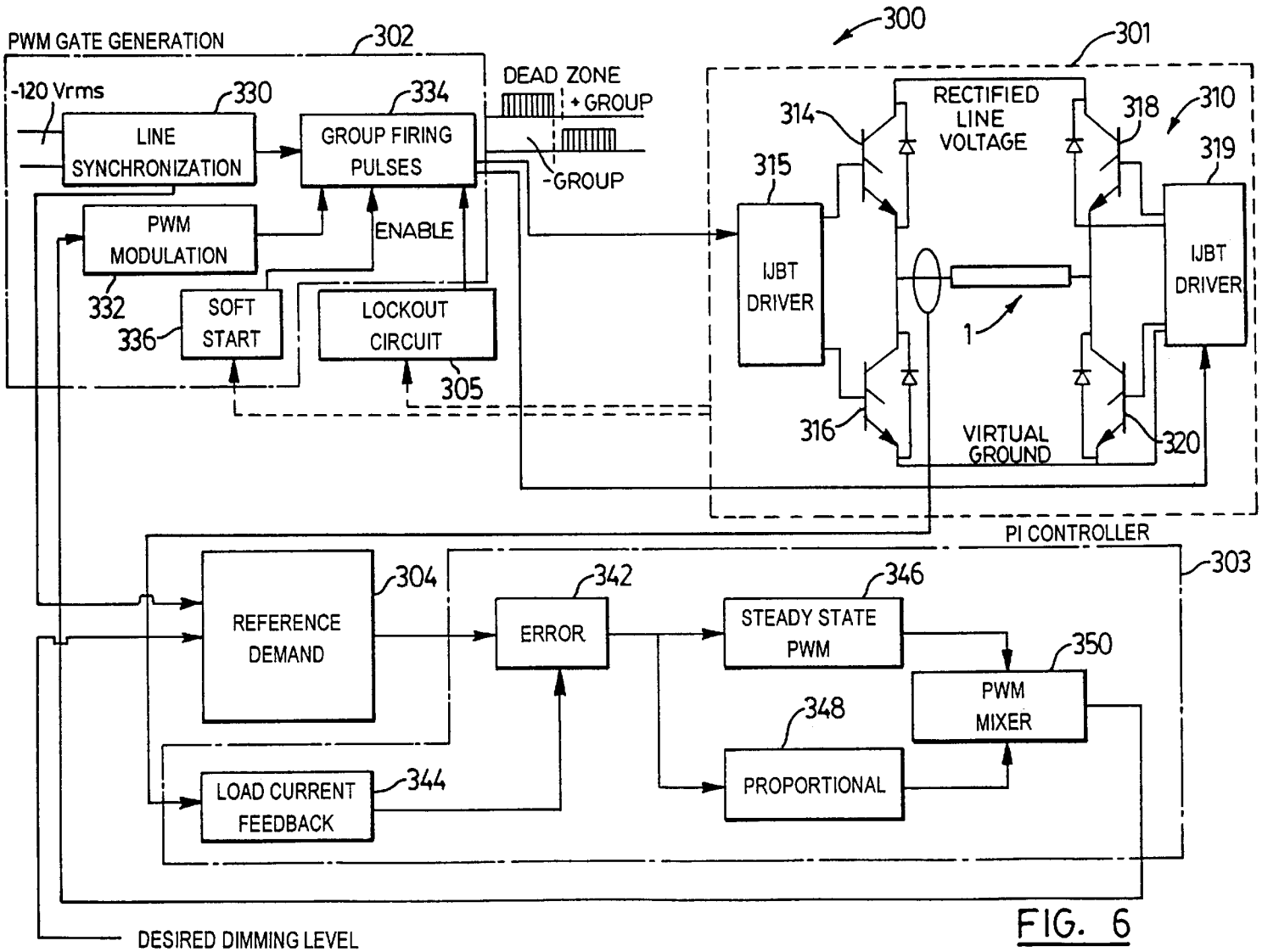
FIG. 6 is a block diagram of a current controlled dimmer according to another embodiment of the present invention.

Another embodiment of a current controlled dimmer according to the present invention is shown in FIG. 6 and depicted generally by reference 300. The current signal is generated by rectifying the AC line voltage and modulating the rectified voltage by a PWM (Pulse Width Modulator) into positive and negative cycles to generate a 60 Hz AC current signal. Referring to FIG. 6, the current controlled dimmer 300 comprises a power output stage 301, a pulse width modulation (PWM) gate generation stage 302, a proportional and integral (P/I) controller stage 303, a reference demand circuit 304, and a lockout circuit 305.

The power output stage 301 is coupled to the fluorescent lamp assembly 1 (or group of lamp assemblies 1*a* to 1*n*) and provides the drive voltage and current. The power output stage 301 comprises an IGBT output drive circuit 310. The IGBT output drive circuit 310 includes four insulated gate bipolar transistors (IGBT's), denoted individually as 314, 316, 318, 320, which are connected in an H-bridge configuration as will be familiar to those skilled in the art. The first pair of IGBT's 314, 316 are driven by a first IGBT driver 315, and the second pair of IGBT's 318, 320 are driven by a second IGBT driver 319. The drivers 315, 319 may be implemented using a commercially available device such as the IR2110 as will be familiar to one skilled in the art. The bridge for the output drive circuit 310 is supplied from a rectified non filtered line voltage ~V. The rectified line voltage ~V is generated by a line synchronization circuit 312 as shown in FIG. 8.

Figure 8:
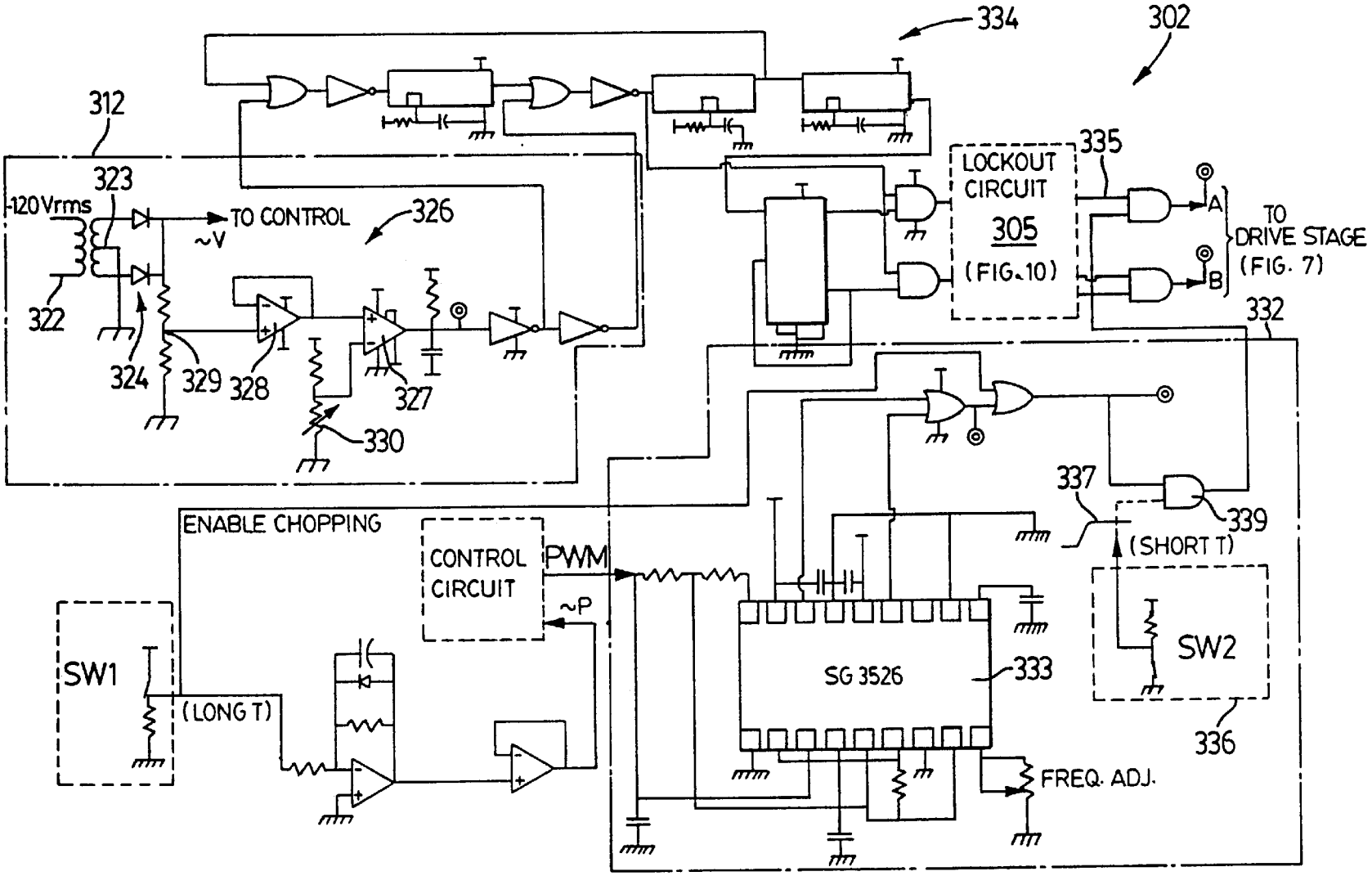
FIG. 8 is a schematic diagram of a PWM gate generation stage for the current controlled dimmer of FIG. 6.

Referring to FIG. 8, the line synchronization circuit 312 comprises a transformer 322, having a secondary with a center-tap 323, and a rectifier 324. As shown in FIG. 8, the bridge rectifier 324 is connected across the secondary winding and the center-tap 323 is coupled to neutral. The transformer 322 receives the AC line or drive voltage $V_{AC}$ which is rectified by the bridge rectifier 324 to produce the rectified line voltage ~V which powers the IGBT bridge in the output drive circuit 310.

Referring to FIG. 6, the PWM gate generation stage 302 comprises a pulse width modulation circuit 332, a group firing pulse circuit 334, and a soft start circuit 336, in addition to the line synchronization circuit 312. As shown in FIG. 8, the line synchronization circuit 312 includes a square wave generator circuit 326 for generating a square wave signal which is locked to the 60 Hz line voltage $V_{AC}$ and has a minimum dead zone. The square wave generator 326 is implemented in known manner and comprises a comparator 327 which is coupled to the output of the transformer 322 through a voltage follower 328 and with a level shifter 329. The comparator 327 includes a potentiometer 330 for adjusting the dead zone.

The PWM modulation circuit 332 provides PWM modulation for generating the AC current signal for the light assembly 1. The PWM modulation circuit 332 as shown in FIG. 8 is implemented in a similar fashion to the PWM generator 132 (as described above for FIG. 4) using a PWM generator 333 such as the commercially available SG3526 device. The PWM generator 333 is configured to provide a minimum OFF time for the IGBT blocking conditions. The modulation frequency is set to 20 kHz in order to be above the audible level.

The group firing pulses circuit 334 reconstructs a positive group signal +Group and a negative group signal −Group as shown in FIG. 6. The group firing pulses circuit 334 receives the square wave output and square wave inverted output from the square wave generator 326. An implementation for the group firing pulses circuit 334 is shown in FIG. 8.

The soft start circuit 336 is also shown in FIG. 8. The soft start circuit 336 generates a soft start enable signal 337. On power-up or upon energizing the AC supply line $V_{AC}$ , the soft start circuit 336 generates the enable signal 337 which serves to disable all signals for the dimmer 300 until the appropriate power supply levels are reached. As shown in FIG. 8, the enable signal 337 is logically AND'd with the PWM modulation signal by AND gate 339. The soft start circuit 336 also synchronizes the zero crossing of the voltage to start firing the IGBT pairs in the output drive circuit 310 only at low voltages.

Figure 9:
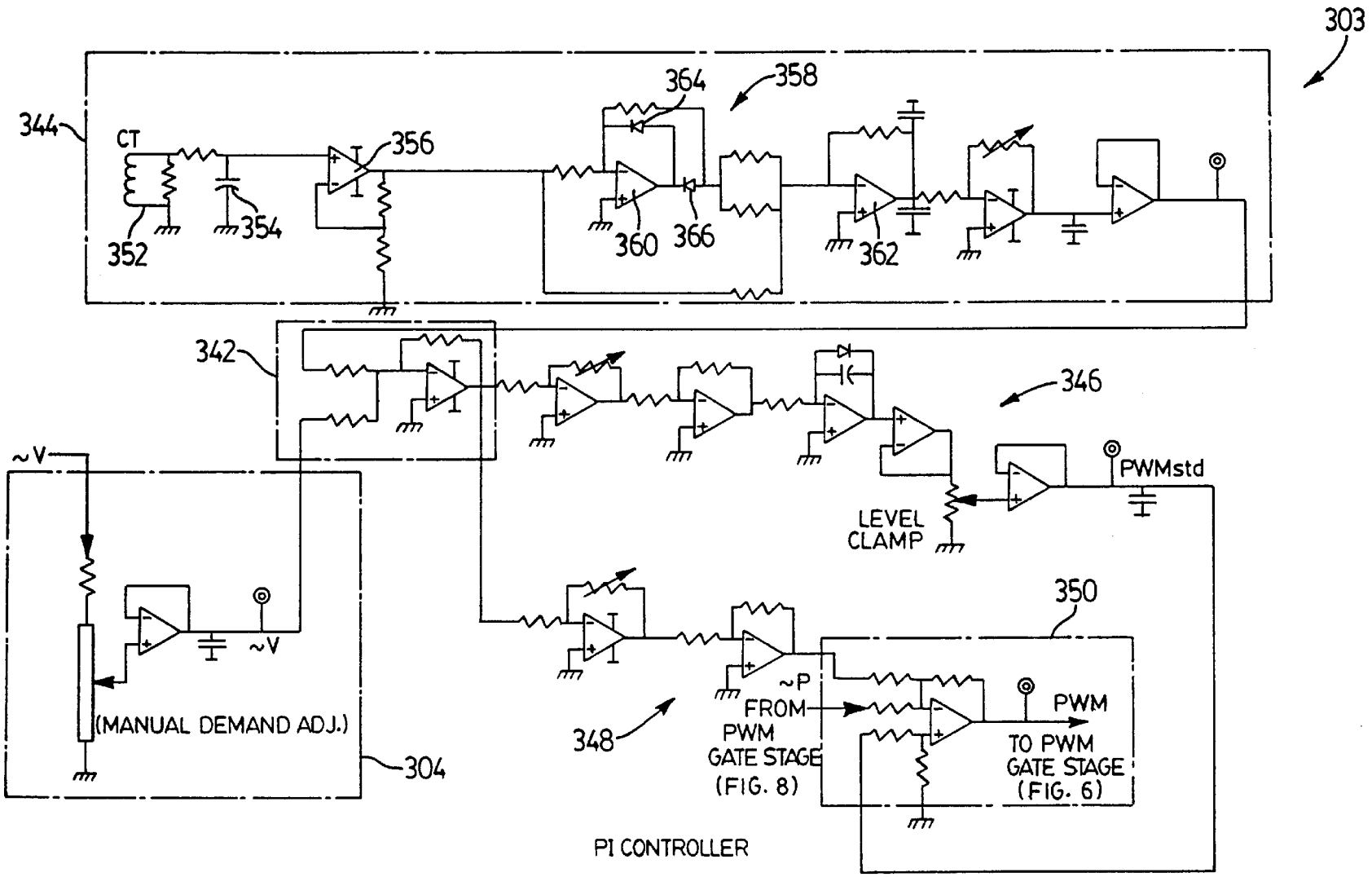
FIG. 9 is a schematic diagram of proportional-integral control stage for the current controlled dimmer of FIG. 6.

Reference is next made to FIG. 9, which shows the proportional and integral (P/I) controller stage 303 in greater detail. The P/I controller 303 comprises an error circuit 342, a load current feedback circuit 344, an integral control loop 346 for the steady state PWM, a proportional control loop 348, and a PWM mixer 350. The error circuit 342 receives an input from the reference demand circuit 304 and another input from the load current feedback circuit 344. The reference demand circuit 304 generates a rectified sinusoidal demand adjust signal $V'_{ADJ}$ having a magnitude corresponding to the desired current in the load (i.e. magnetic ballast 2). The demand adjust signal $V'_{ADJ}$ provides a reference signal from which the magnitude and waveform shape for the AC current waveform $I_{AC}$ is derived. The reference demand circuit 304 is implemented in a fashion similar as the circuitry for the demand adjust signal $V_{ADJ}$ described above for FIG. 5.

The load current feedback circuit 344 monitors the load current (i.e. the current in the magnetic ballast 2) and is shown in greater detail in FIG. 9. The load current feedback circuit 344 includes a current transformer 352 which provides an output indicative of the load current. The output current from the transformer 352 is filtered by a capacitor 354 to reject the high frequency noise components while still maintaining a bandwidth of 5 kHz. The filtered signal is conditioned by an amplifier 356 and rectified by a precision rectifier circuit 358. The precision rectifier 358 comprises operational amplifiers 360, 362 and diodes 364, 366 which are configured in known manner. The level of the rectified signal is conditioned further and the level adjusted before being outputted as a load current signal $C_{load}$ for the error circuit 342. The error circuit 342 generates an error signal Err which is the difference between the actual load current (i.e. signal $C_{load}$) and the desired demand setting (i.e. signal $V'_{ADJ}$).

The integral controller 346 generates a DC base voltage which represents the steady state PWM modulation rate for the PWM modulation circuit 332. As shown in FIG. 9, the integral controller 346 comprises an integrator stage and a clamping circuit which adjusts the level of the DC base voltage signal to a level which is compatible with the PWM chip 333 (FIG. 8). The integral controller 346 is implemented in a similar fashion to the integral controller branch 226 described above with reference to FIG. 5. The PWM mixer 350 mixes the outputs from the integral controller 346 and the proportional controller 348 and generates an output signal PWM which set the modulation level for the PWM modulation circuit 332.

The proportional controller 348 generates a signal which is the error signal Err amplified to an optimum gain level. The output of the proportional controller 348 provides the dynamic modulation signal which directs the PWM modulation circuit 332 to produce the desired sinusoidal shape for the AC current signal. The proportional controller 348 is implemented in a similar fashion to the proportional controller 228 described above with reference to FIG. 5.

Figure 7:
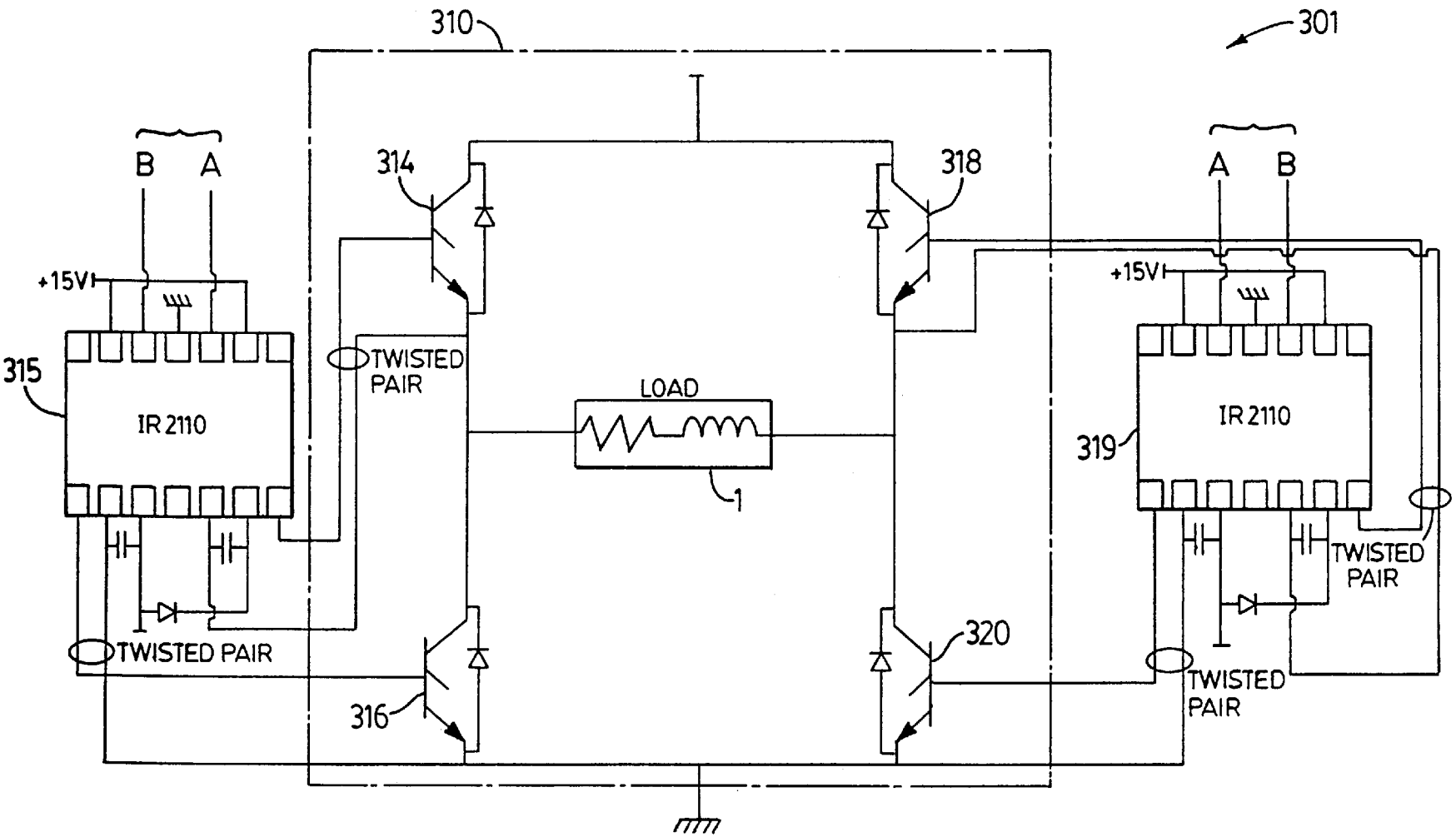
FIG. 7 is a schematic diagram of a power and driver stage for the current controlled dimmer of FIG. 6.
Figure 10:
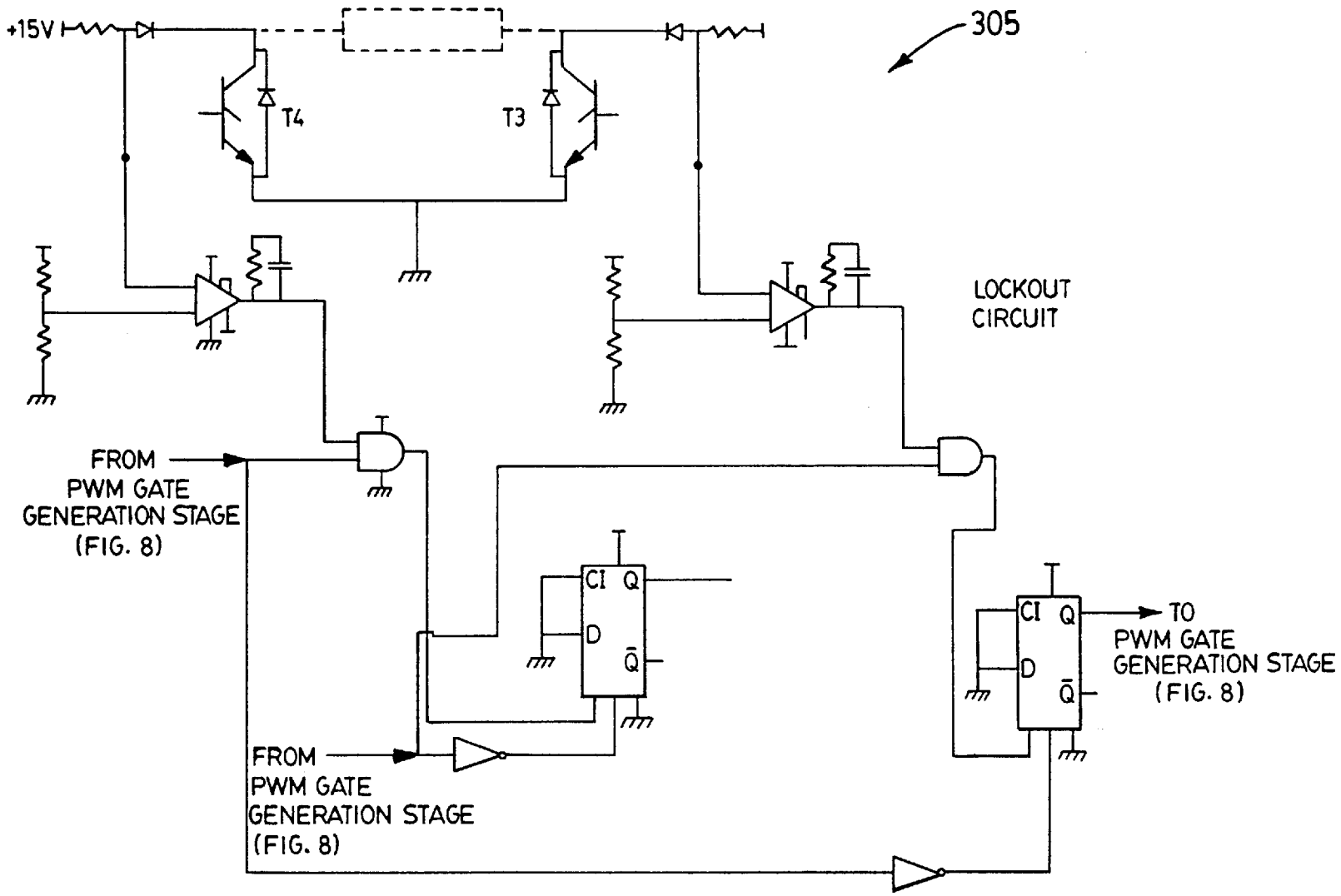
FIG. 10 is a schematic diagram of a lockout circuit for the current controlled dimmer of FIG. 6.

The lockout circuit 305 detects a recovery current in the IGBT bridge 311 (FIG. 7) and locks out the control signals from the group firing pulses circuit 334 which, in turn, control the IGBT drivers 315 and 319 (FIG. 7) in the driver. It will be appreciated that the purpose of the lockout circuit 305 is to prevent "shoot through" in the IGBT bridge 311 by allowing recovery currents. The lockout circuit 305 is implemented as shown in FIG. 10.

Figure 11:
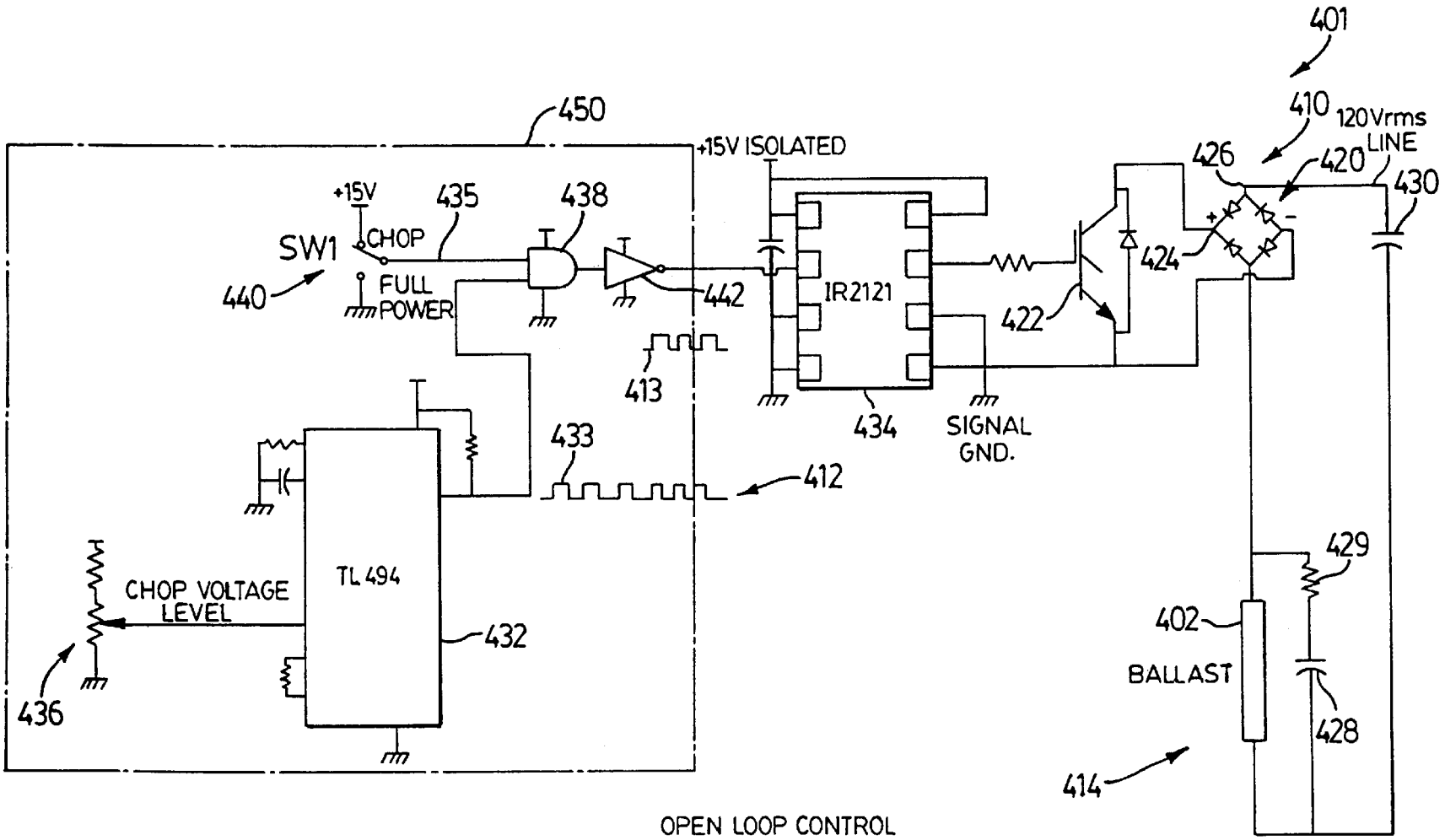
FIG. 11 is a schematic diagram of an open-loop current controlled dimmer according to another embodiment of the present invention.

Reference is next made to FIG. 11, which shows a current controlled dimmer 401 according to another embodiment of the present invention. The current controlled dimmer 401 shown in FIG. 11 is intended primarily for use with a single magnetic ballast 402, i.e. one fluorescent lamp assembly 401 comprising the magnetic ballast 402 and a pair of fluorescent tubes.

As shown in FIG. 11, the current controlled dimmer 401 comprises an AC switching stage 410, a firing stage 412, and an output stage 414.

The AC switching stage 410 comprises a full-wave bridge rectifier 420 and an insulated gate bipolar transistor (IGBT) 422. The bridge rectifier 420 comprises four diodes which are connected in a bridge configuration to form an AC branch 424 and a DC branch 426. One terminal of the DC branch 424 is connected to the collector of the IGBT 422 and the other terminal is connected to the emitter of the IGBT 422. For the AC branch 424, one terminal is connected to the AC supply voltage (i.e. terminal 18), and the other terminal is connected to the load, i.e. input terminal of the magnetic ballast 402.

As shown in FIG. 11, the output stage 414 comprises a first capacitor 428, a resistor 429 and a second capacitor 430. The capacitor 428 and the resistor 429 are connected in series and coupled in parallel across the ballast 402. The resistor 429 and the capacitor 428 provide a parallel load for the ballast 402 which permits free-wheeling when the AC supply voltage to the ballast 402 is turned off during the chopping interval. The capacitor 428 provides energy transfer for the inductive energy stored in the magnetic ballast 402. The resistor 429 limits the current stress in the capacitor 428 and the ballast 402 when the full AC supply or line voltage is applied during the ON interval in the chop cycle. During the OFF interval, the voltage on the ballast 402 decreases and there is an inrush of current into the capacitor 428, i.e. free-wheeling.

The firing stage 412 comprises a pulse width modulator 432 and a driver chip or integrated circuit 434, such as the IR2121. The pulse width modulator 432 generates a pulse width modulated output signal 433. The output signal 433 has a variable duty cycle which is set by a chop voltage signal derived from a potentiometer 436. The pulse width modulated output signal 433 is logically AND'd by logic gate 438 with a chop enable signal 435 and inverted by an inverter 442 to produce a modulation or chopping control signal 413. The chop enable signal 435 is active HIGH and produced by a chop enable switch 440. When the chop enable signal 435 is set LOW, the current dimmer 401 is disabled and the lamp is operated at full intensity. The chopping control signal 413 is applied to the input of the driver 434. The driver 434 provides 0 to +15V offset to the chopping control signal 413 for turning the IGBT 422 ON and OFF. When the chopping control signal 413 is HIGH, the IGBT 422 is ON and thus the AC switch 410 is closed, and a current derived from the AC line voltage will flow through the bridge 420 into the magnetic ballast 402 in the lamp assembly. Conversely, when the chopping control signal 413 is LOW, the IGBT 422 is turned OFF and the AC switch 410 is opened, and a free-wheeling path across the load, i.e. the magnetic ballast 2, is established by the resistor 429 and capacitor 428 connected in parallel with the ballast 402.

In experimental testing, it has been found that the open loop current controlled dimmer 401 provides an output intensity control range from full 100% power to 20% power before there is any noticeable flicker for a single ballast (i.e. lamp) arrangement. Advantageously, the implementation for the open loop current controlled dimmer 401 is simplified and requires a single +15 Volt power supply, a single IGBT 422 and bridge 420.

The open loop current dimmer 401 may be extended to control the output intensity of multiple lamp assemblies connected in parallel. For such an arrangement, a capacitance value of 0.75 $\mu$F for the capacitor 428 for each magnetic ballast 402 (connected in parallel) was found to be sufficient, and the need for the resistor 429 is eliminated because of the natural damping of the circuit. In experimental testing for multiple ballasts 402 (i.e. lamp assemblies) , the open loop current dimmer 401 was found to provide output intensity control over the range of 100% (full power) to 70% output before therefore was any noticeable flicker in the light output.

Figure 12:
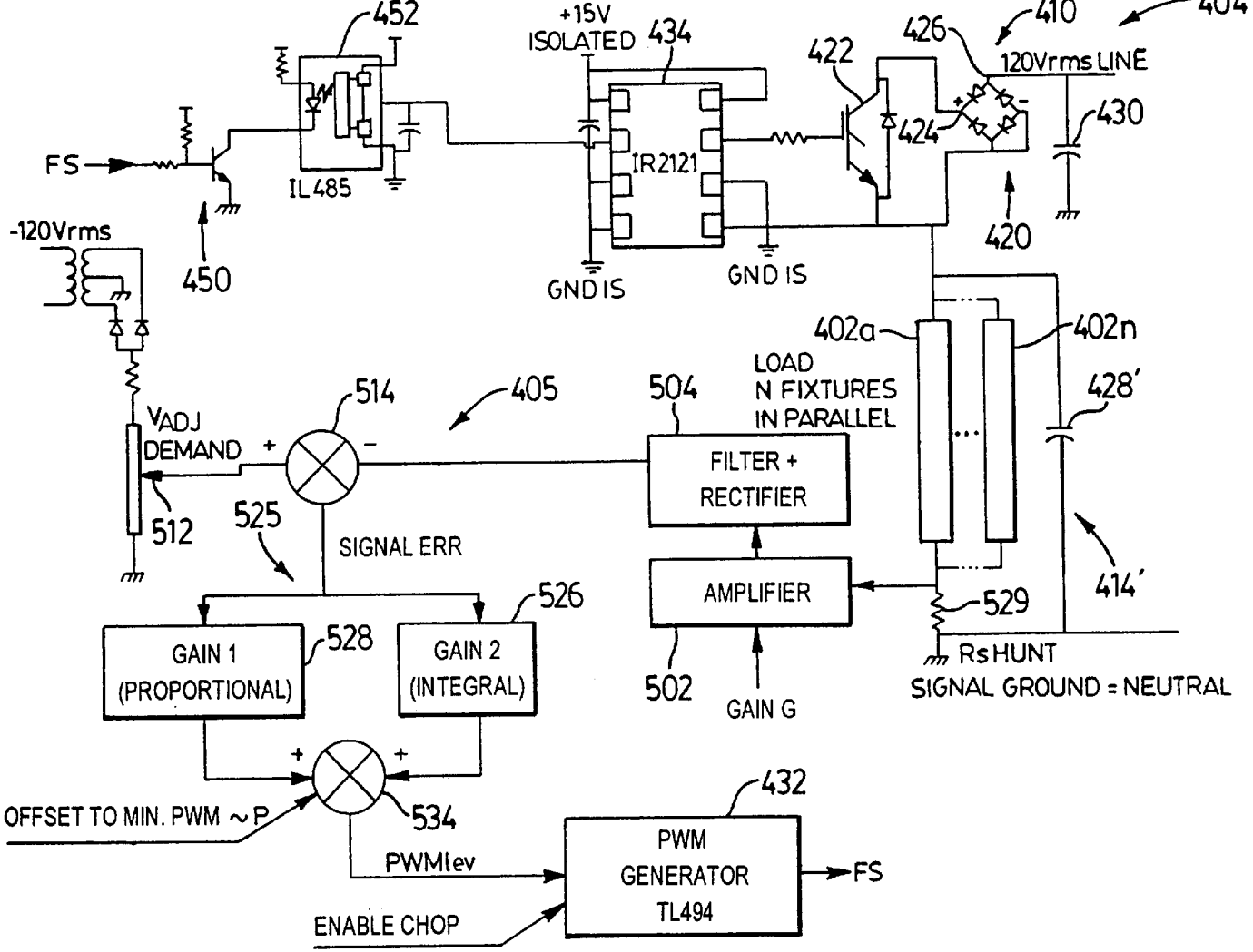
FIG. 12 is a schematic diagram of the current controlled dimmer of FIG. 11 with a feedback control loop.

Reference is next made to FIG. 12 which shows another embodiment of a current controlled dimmer 404 according to the present invention. The current controlled dimmer 404 is similar to the dimmer 401 of FIG. 11 with the addition of a feedback control loop or circuit denoted generally by reference 405. The current controlled dimmer 404 with feedback control circuit 405 is suitable for controlling a number of ballasts (i.e. lamp assemblies) connected in parallel and shown individually as 402*a*, . . . 402N.

As shown in FIG. 12, a capacitor 428' is connected in parallel across the ballasts 402. The capacitor 428' has a capacitance value of 0.75 $\mu$F for each ballast 402, i.e. N×0.75 $\mu$F. The capacitor 428' provides a free-wheeling path for the inductive energy stored in the magnetic ballast(s) 402 during the OFF intervals in the chopping cycle.

Referring to FIG. 12, the IGBT 422 is turned ON and OFF, i.e. chopped, by a chopping or modulation control signal FS. The chopping control signal FS is generated by the pulse width modulator generator 432. The chopping control signal FS output from the PWM generator 432 is coupled to the driver 434 through a buffer 450 and an opto-isolator 452. The buffer 450 is implemented using a discrete NPN transistor. The opto-isolator 452 is provided to allow for a floating power supply, and the output of the opto-isolator 452 is coupled to the base of the IGBT 26 through the driver chip 434. The driver chip 434 provides a 0 to +15V offset for the modulation control signal FS for turning the IGBT 422 ON and OFF.

The feedback control circuit 405 is implemented in similar fashion to the control circuit 16 described above with reference to FIG. 5. As shown in FIG. 12, the control circuit 16 comprises an amplifier 502, a filter and rectifier circuit 504, an error circuit 514, a manual demand (i.e. output intensity) adjust circuit 512, a proportional/integral feedback loop 525, and a PWM mixer 534. The proportional/integral feedback loop 525 comprises an integral control branch 526, and a proportional control branch 528.

The control circuit 16 generates a pulse width modulation level control signal PWMlev which determines the pulse width or duty cycle of the modulation control signal FS. The modulation level control signal PWMlev is derived from a feedback current RS which flows in a shunt resistor 529. The feedback current RS is amplified and conditioned by the amplifier 502 and the filter and rectifier circuit 504 and provides one input to the error circuit 514. The amplifier 502 has an adjustable gain and is implemented in a similar fashion to the amplifier 202 described above in FIG. 5. The filter and rectifier circuit 504 is implemented in a similar fashion to the filter and rectifier 204 described above in FIG. 5. The other input to the error circuit 514 is the demand adjust signal $V_{ADJ}$, which represents the desired output level for the lamp(s). The error circuit 514 produces an error signal Err which represents the difference between the actual intensity output (i.e. the feedback current RS) and the desired demand adjust level $V_{ADJ}$. The error circuit 514 is implemented in a similar fashion to the error circuit 204 described above in FIG. 5.

The error signal Err is fed to a proportional/integral feedback control loop 525, and in particular the integral control branch 526 and the proportional control branch 528. The integral controller 526 is implemented in a similar fashion to the integral controller 226 described above in FIG. 5 and provides a long time constant and is intended to control the steady state level of the sinusoidal waveform. The integral controller 526 generates a DC base voltage which represents the steady state PWM modulation rate for the pulse width modulation generator 432. The proportional controller 528, on the other hand, is used to correct errors between the desired demand and the actual load current. The proportional controller 528 provides the dynamic modulation signal which directs the pulse width modulation generator 432 to produce the desired sinusoidal shape for the AC current signal $I_{AC}$. The proportional controller 528 is implemented in a similar fashion to the controller 228 described above in FIG. 5. The PWM mixer 534 mixes the outputs from the integral controller 526 and the proportional controller 528 with a minimum PWM offset signal ~P to generate the pulse width modulation level control signal PMWlev. The PWM mixer 534 is implemented in a similar fashion to the PWM mixer 234 described above in FIG. 5.

Advantageously, the current controlled dimmer with feedback control 404 utilizes only a single AC switching element and provides a free wheeling path (through the capacitor 428') which is static. By utilizing a static free wheeling path, the likelihood of a short circuit through the output stage 414' is minimized and the need for trip circuits and synchronization signals is eliminated. Advantageously, this reduces the component count and subsequent cost of the current controlled dimmer 404.

In experimental testing, it has been found that the current controlled dimmer 404 with feedback control provides an output intensity control range from full 100% power to 65% power before there is any noticeable flicker for multiple ballast(s), i.e. lamps. Below 65% output, a slight flickering was noticeable with possible tube drop outs. However, with the addition of the feedback control loop 405, the total power output will match the desired output level (i.e. demand adjust level), and if one tube drops out, the other tubes compensate as their individual lumen output is increased to the total power output level. Advantageously, the current controlled dimmer 404 provides smooth continuous control of the lumen output in a multiple lamp arrangement.

The present invention may be embodied in other specific forms without departing from the spirit or essential characteristics thereof. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. An apparatus for controlling the output intensity level of a gas discharge lamp having a magnetic ballast, said apparatus comprising:

(a) means for coupling an AC supply voltage to the magnetic ballast for energizing the ballast to produce a discharge in the gas discharge lamp;

(b) means for generating an intensity level signal for setting the output intensity level for the lamp;

(c) switch means for switching said AC supply voltage to generate an AC current signal for powering the gas discharge lamp, said switch means being responsive to a chopping control signal for varying the amplitude of the AC current signal and thereby varying the output intensity of the lamp;

(d) controller means for controlling said switch means, said controller means including a pulse width modulator for generating said chopping control signal, said pulse width modulator having means responsive to said intensity level signal for generating said chopping control signal with a duty cycle derived from said intensity level signal.

2. The apparatus as claimed in claim 1, wherein said controller means includes a current feedback control loop comprising means for generating a load current signal indicative of the current flowing in the ballast and means for adjusting said chopping control signal based on the difference between the intensity level signal and the load current signal.

3. An apparatus for controlling the output intensity level of a gas discharge lamp having a magnetic ballast, said apparatus comprising:

(a) means for coupling an AC supply voltage to the magnetic ballast for energizing the ballast to produce a discharge in the gas discharge lamp;

(b) means for generating an intensity level signal for setting the output intensity level for the lamp;

(c) switch means for switching said AC supply voltage to generate an AC current for powering the gas discharge lamp, said switch means being responsive to a chopping control signal for varying the amplitude of the AC current and thereby varying the output intensity of the lamp;

(d) controller means for controlling said switch means, said controller means including means responsive to said intensity level signal for generating a modulation control signal, and said controller means further including a pulse width modulator for generating said chopping control signal, said pulse width modulator having means responsive to said modulation control signal for generating said chopping control signal with a duty cycle derived from said intensity level signal.

4. The apparatus as claimed in claim 3, wherein said controller means includes a current feedback control loop comprising means for generating a load current signal indicative of the current flowing in the ballast and means for adjusting said modulation control signal based on the difference between the intensity level signal and the load current signal.

5. The apparatus as claimed in claim 3, wherein said intensity level signal comprises a sinusoidal signal derived from said AC supply voltage.

6. The apparatus as claimed in claim 4, wherein said means for adjusting said modulation control signal comprises a proportional integral controller having an integral control loop and a proportional control loop, said integral control loop including means for generating a steady state control signal corresponding to a steady state pulse width modulation rate for said pulse width modulator, and said proportional control loop including means for generating an error signal based on the difference between the intensity level signal and the load current signal.

7. The apparatus as claimed in claim 6, wherein said integral control loop includes means for introducing a delay so that said AC current lags said AC supply voltage to produce a power factor of approximately 0.9.

8. The apparatus as claimed in claim 4, wherein said switch means comprises a bridge rectifier and a transistor, said bridge rectifier having an input port for receiving said AC supply voltage, an output port coupled to the magnetic ballast of the gas discharge lamp, and a control port, said transistor having an emitter, a base, and a collector, the emitter and the collector of said transistor being coupled to said control port for actuating said bridge rectifier in response to said chopping control signal being applied to the base of said transistor.

9. A method for controlling the output intensity level of a gas discharge lamp having a magnetic ballast, said method comprising the steps of:

(a) applying a voltage to the magnetic ballast for energizing the ballast and producing a discharge in the gas discharge lamp;

(b) modulating the voltage to produce an alternating current for powering the gas discharge lamp, said alternating current having a controllable waveshape substantially following a reference signal;

(c) generating an intensity level signal from said reference signal for setting the output intensity of the lamp;

(d) varying the modulation of the voltage in response to an error signal, said error signal comprising the difference between said intensity level signal and a feedback current signal, so that the output intensity level of the gas discharge lamp follows said reference signal.

10. The method as claimed in claim 9, wherein said voltage comprises a sinusoidal waveform and said alternating current comprises a similar sinusoidal waveform having essentially the same shape as said voltage waveform.

11. The method as claimed in claim 9, wherein said step of modulating further includes the step of introducing a delay between said alternating current and said voltage to produce a power factor of at least 0.9.

12. The method as claimed in 11, wherein said step of modulating said voltage comprises pulse width modulation.

* * * * *